United States Patent [19]

Knight

[11] Patent Number: 4,896,523

[45] Date of Patent: Jan. 30, 1990

[54] FINGER OPENING MECHANISM FOR TRANSFER PRESS

[75] Inventor: David W. Knight, Stratford, Conn.

[73] Assignee: The U.S. Baird Corporation, Stratford, Conn.

[21] Appl. No.: 240,097

[22] Filed: Sep. 2, 1988

[51] Int. Cl.[4] ..... B21J 13/08

[52] U.S. Cl. ..... 72/405; 72/421; 198/621

[58] Field of Search ..... 72/405, 421; 198/621; 414/751

[56] References Cited

U.S. PATENT DOCUMENTS

| | | | |
|---|---|---|---|
| 2,934,194 | 4/1960 | Adams | 198/621 |
| 4,404,837 | 9/1983 | Allen et al. | 72/405 |
| 4,735,303 | 4/1988 | Wallis | 198/621 |
| 4,750,348 | 6/1988 | Hennah | 72/405 |

FOREIGN PATENT DOCUMENTS

| | | | |
|---|---|---|---|
| 2047197 | 4/1971 | Fed. Rep. of Germany | 72/405 |

*Primary Examiner*—Daniel C. Crane

*Attorney, Agent, or Firm*—Parmelee, Bollinger & Bramblett

[57] ABSTRACT

A multi-station press, having a press frame, a press bed and a ram tooled for performing sequential work operations at plural stations and a transfer mechanism for transporting work pieces from one station to the next, has positively driven finger operating mechanism. The transfer mechanism includes transfer rails and fingers extending inwardly toward the work station. The finger operating mechanism includes an actuating rod mounted for sliding movement on each transfer rail, a finger pull-back lever pivoted to the transfer rail and engaging the finger, with the actuating rod including an upstanding tooth for engaging the finger pull-back lever. In one embodiment two teeth are provided for rotating the lever to both open and close the fingers. An actuating lever pivotally mounted to the transfer rails operates the actuating rods. The actuating lever includes a depending follower received in a roll slot member mounted for lateral sliding movement on the press frame, the roll slot accommodating the longitudinal reciprocating motion of the transfer rail and actuating lever mounted thereto. A cam lever is pivotally mounted to the press frame and has a first end engaged with the roll slot member. The other end of the cam lever is driven by a press cam shaft. The cam assembly includes first and second cams mounted to a hub assembly which permits adjustment of the cam relative to each other. Each cam further comprises an adjustment segment for extending the profile, as desired. The cam lever includes two cam followers, one engaged with each cam, providing a positive drive for the cam lever and the entire finger operating mechanism.

39 Claims, 5 Drawing Sheets

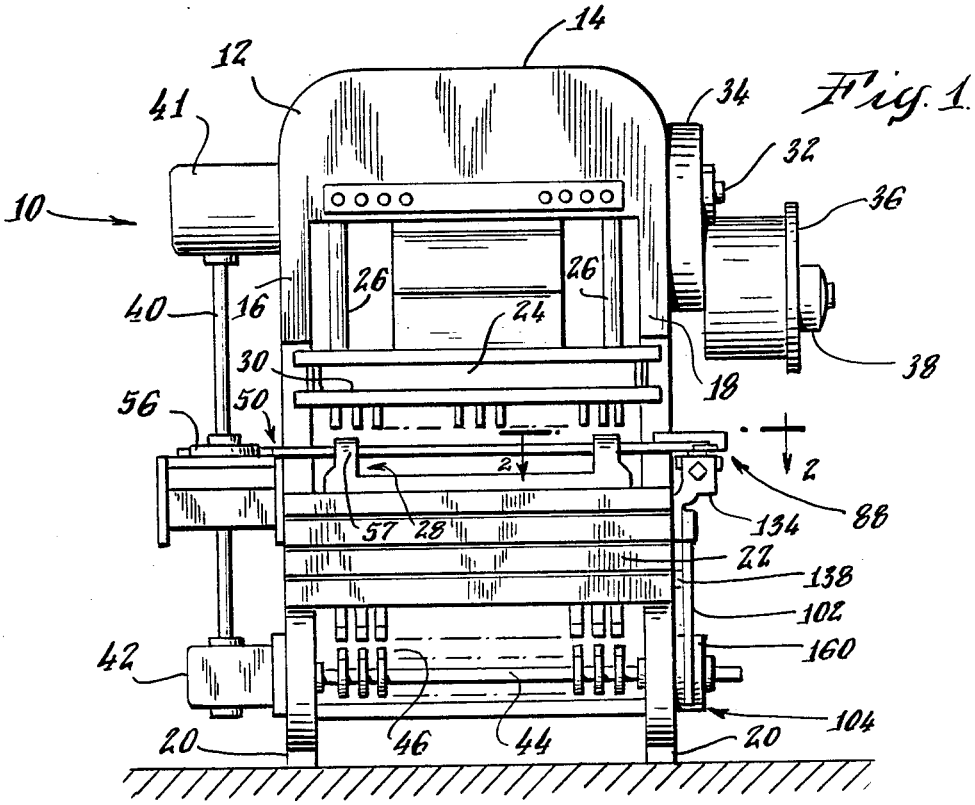
Fig. 1.
Fig. 4.
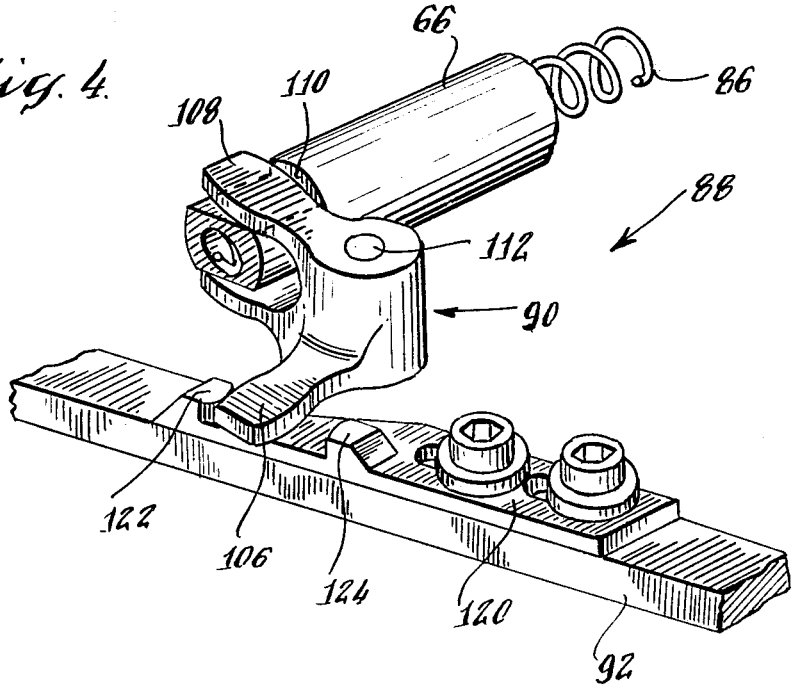

52
96
116
114
96
54
117
118
100
130
128
10
132
144
142
134
12
145
145
143
102
102
140
138
146
104
164
160
150
162
170
166
172
180
182
146
162
8
170
152
148
182
164
178
44
178
176
168
150
160
8

184

52
96
116
114
96
54
117
118
100
130
128
132
144
142
134
10
145
145
12
143
102
140
138
146
148
152
160
182
104
178
150
164
170
104
44
162

FINGER OPENING MECHANISM FOR TRANSFER PRESS

FIELD OF INVENTION

This application relates to a finger opening mechanism for a multiple-station press, and more particularly to a mechanism for retracting the part-carrying fingers extending inwardly from the transfer rails of a multiple station metal forming press, wherein the finger retracting mechanism is positively driven independently of motion of the transfer rails.

BACKGROUND OF THE INVENTION

The invention is applicable multiple station strip metal forming presses of the type including a vertically reciprocating ram for mounting and operating tools. Such multi-station presses have been manufactured and sold by The U.S. Baird Corporation, Stratford, Conn., under the trademark Multiple Transfer for many years. These presses are well suited for the manufacture of metal parts made sequentially in a succession of drawing operations at the stations. In this type of machine, coil strip stock is fed in widths ranging from a fraction of an inch through up to seven or more inches on the larger machines. Blanks are automatically cut from the strip stock and a vertical blank transfer mechanism positively holds and carries the blank down to the transfer level, where it is picked up by the transfer fingers of a horizontal transfer mechanism. Usually the blank is transferred through a succession of draw dies in as many as fifteen (15) individual work stations and, finally, is ejected as a completed part. This type of completely automatic operation allows piercing, forming, drawing, lettering, embossing and flanging, as well as side slotting, side piercing and reverse drawing at production rates which have exceeded 250 parts per minute. From blanking operation to finished part ejection, all tooling is mounted in standardized precision die sets to facilitate set up and minimize down time. Each station may be individually adjusted or serviced. Complete die sets can be interchanged without losing tool adjustment. Frequent complete change of jobs or intricate toolings will justify extra die sets.

An example of an early press of this type developed by the assignee of the instant invention which sets forth the essential nature of this type of press is found in U.S. Pat. 2,049,915 dated Aug. 4, 1936, in the name of Arthur J. Lewis and assigned to the assignee of the instant application. Of course, a large number of improvements have been made since the issuance of the Lewis patent, primarily with a view toward producing higher speeds, lower ultimate tooling costs, precision operation, tool adjustment and replacement, minimizing down time, minimizing scrap loss and, in general, providing greater versatility and operational sophistication for the presses. Some of the advancements in multi-station strip metal forming presses are set forth in my U.S. Pat. 4,166,372 issued Sept. 4, 1979 for a Multi-Station Transfer Press Having A Punch-Extending Means, my U.S. Pat. No. 4,406,148 issued Sept. 27, 1983 for a Multi-Station Transfer Press Having Transfer Slide Safety Release Means, and my U.S. Pat. No. 4,655,071 issued Apr. 7, 1987 for a Transfer Press with Quick-Change Die Set Arrangement.

As the speed and sophistication of the multi-station metal forming press have increased, the transfer fingers of the horizontal transfer mechanism have become a limiting factor in speed of operation and quality of the final part. The horizontal transfer mechanism, which carries parts to the next sequential station between forming strokes of the press, generally comprises two transfer rails having opposed pairs of inwardly extending fingers. The fingers are spring biased inwardly and are cammed outwardly to accept and grip parts and to clear the punches and dies. For this purpose, the fingers have an end pad which includes leading and trailing cam surfaces flanking a concave recess for partially surrounding and holding the part. Two opposed fingers thereby together engage, hold and support the part during transfer from one station to the next sequential station. The fingers are often provided with upper and lower inclined cam surfaces as well, so that vertically moving parts and/or portions of the tool and die set will cam the fingers to the open positions for clearance, as required, to engage and release parts.

The camming of the fingers has several drawbacks. First, the finger pads themselves are subject to wear and accordingly must be fabricated of steel to achieve long life. Even though the steel may be highly polished or even chrome plated, the camming of the fingers over the parts tends to leave scratches and marks on the parts. If a smooth, scratch-free surface is desired on the part for esthetic or functional reasons, these scratches caused by the transfer fingers must be polished out. Also because of the manner in which the finger pads cam over the parts, the portion of the finger pad engaging the part is limited to provide a relatively easy engagement and release of the part. All of these factors have an effect on the speed of operation of the metal forming press as well as the quality of the parts produced thereby.

SUMMARY OF THE INVENTION

The invention herein is directed toward a horizontal transfer mechanism for transferring parts sequentially from station to station in a multi-station metal forming press. The transfer mechanism includes transfer rails which are driven horizontally in reciprocating longitudinal motion timed with the vertically reciprocating press ram. The transfer rails mount fingers extending inwardly to grip work pieces, and the fingers are spring biased inwardly. The transfer rails further mount a mechanical linkage for retracting the fingers. Therefore, the fingers may be opened, positioned with a part therebetween, and released to embrace and hold the part for carrying it to the next station all without necessity of camming the fingers over the part to engage it. Also, the fingers may be opened to release a part at the next station, prepatory to forming operations there and the fingers may remain open as the transfer rails are returned to the previous station, to minimize interference with tooling, strippers, etc. According to one aspect of the invention, the mechanical linkage includes an L-shaped finger pull-back lever for each finger, one arm of the lever being bifurcated to receive the finger and operate against the end surfaces of a notch in the finger. According to other aspects of the invention, the finger operating mechanism further includes an actuating rod extending along the transfer rail to pass by the finger locations on the transfer rail. A finger pull-back tooth is mounted on the actuating rod at each of the finger locations, to engage the other arm of the finger pull-back lever. At the end of the transfer rails, an actuating lever is mounted spanning the rails, so that the actuating lever is attached to the actuating rods for each of the transfer rails, with the pivot mounting of the actuating lever therebetween.

The horizontal transfer mechanism further comprises means for operating the mechanical linkage to open the fingers independently of the reciprocating motion of the transfer rails. This is accomplished by rotating the actuating lever to drive the actuating rods. The actuating lever has a follower in the form of a depending roller which is received in a longitudinal roll slot of a roll slot member. Thus, the actuating lever roller rides in the roll slot and accommodates longitudinal motion of the transfer rails as they reciprocate, without operating the actuating lever and fingers. The roll slot member is laterally slideable to rotate the actuating lever and thereby open the fingers. The roll slot is further laterally slideable in the opposite direction to close the fingers, or to release the finger pull-back levers permitting the fingers to close by operation of their spring bias, as desired.

Drive means are provided for laterally displacing the roll slot member at selected desired times. The means conveniently takes the form of a medially-pivoted cam lever having one end engaged with the roll slot member and having its other end operated by a cam assembly for selecting the timing. According to one aspect of the invention, the cam assembly includes two separate cam members and the cam lever is bifurcated for mounting a first cam follower roller engaging one of the cams and a second cam follower roller engaging the second of the cams. This achieves positive displacement of the cam lever. Each of the cams is fabricated with an adjustable arcuate adjustment segment, for fine adjustment of the cam timing and for establishing positive engagement with the lever. The cam lever also includes an adjustable arm for engaging the roll slot member.

The horizontal transfer mechanism positively opens the transfer fingers and thereby avoids necessity of camming the transfer fingers into surrounding engagement with the parts. Finger pads made of nylon or other more easily fabricated material are advantageously used with the positive finger opening mechanism, and the finger ends are also advantageously configured to surround a greater portion of the part for better holding capability. The finger openings and closings are timed to engage and hold the part as it is stripped from a punch, to transfer the part to the next sequential station, and to release the part as the next punch is inserted and the part engaged with the lower die set.

Accordingly, it is the principal object of the invention herein to provide an improved transfer mechanism for multi-station metal forming presses.

It is another principal object of the invention herein to provide a transfer mechanism with positive finger opening and release action.

It is an additional object of the invention herein to provide a transfer mechanism with positive finger opening and release action wherein the fingers are opened independently of the motion of the transfer rails.

It is a still further object of the invention herein to also provide a positively driven mechanical linkage for retracting the fingers independently of the motion of the transfer rails, and in particular to provide a mechanical drive for elements of the linkage traveling with the transfer rails from a drive source on the stationary press frame.

It is yet another object of the invention herein to provide a cam drive for opening the fingers, wherein the cam drive operates a lever by positive displacement.

Other and more specific objects and features of the invention herein will in part be recognized by those skilled in the art and will in part appear from a perusal of the following description of the preferred embodiment of the invention and the claims, taken together with the drawings.

DRAWINGS

FIG. 1 is a front elevation view of a multi-station metal forming press which incorporates a transfer mechanism with a finger operating mechanism according to the invention herein;

FIG. 4 is a perspective view of the finger pull-back linkage of the finger operating mechanism;

The same reference numerals refer to the same elements throughout the various figures.

DESCRIPTION OF PREFERRED EMBODIMENT

Figures 2, 3:
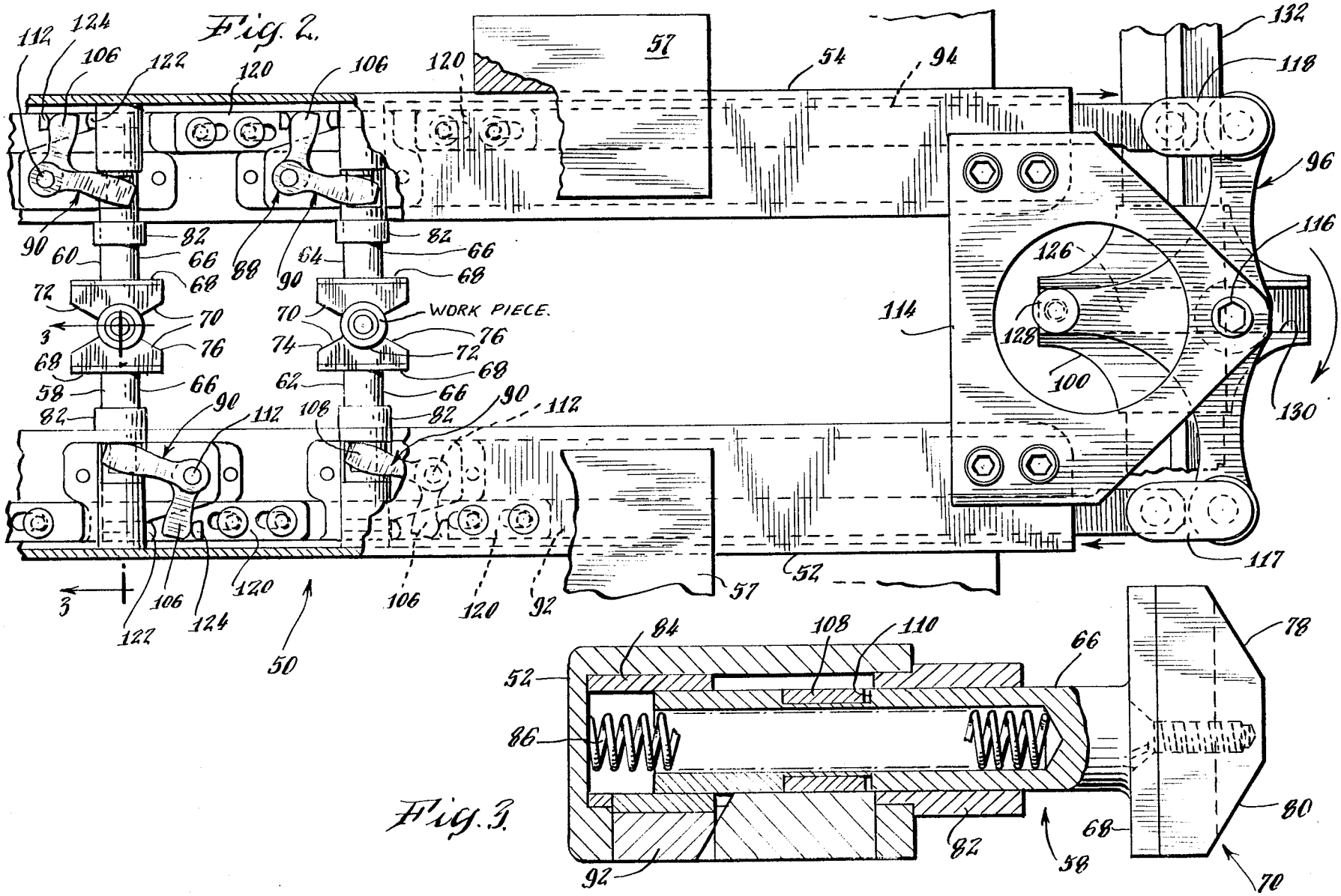
FIG. 2 is a partial sectional view of the multi-station press of FIG. 1, taken generally along the lines 2—2 of FIG. 1 showing the transfer mechanism with the fingers in their closed position.
FIG. 3 is a partial sectional view of the transfer mechanism, taken along the lines 3—3 of FIG. 2, showing one of the fingers.

FIG. 1 illustrates, from a front view, a multiple station metal forming press 10 incorporating a transfer mechanism 50 according to the invention herein. Other than for the detailed description of the finger operating mechanism of the transfer mechanism, the remainder of the multi-station press 10 which is shown in the drawings and which will be described herein is for illustrative purposes only, and is in part schematic. The principal purpose of the invention herein is to improve the transfer capability in multi-station presses of the type disclosed n the referred to Lewis patent, and the invention is applicable to multi-station presses other than the particular one shown herein.

The multi-station press 10 comprises a frame 12 which includes at its top a generally horizontally extending crown 14 supported by a pair of rugged side walls 16 and 18 which extend vertically and at their lower ends are formed with mounting feet 20. Spaced upwardly from the feet of the press is a solid press bed 22 that extends horizontally between and is supported by the walls 16 and 18. Mounted for predetermined controlled vertical reciprocation below the crown 14 and between the walls 16 and 18 is the ram 24. The ram is mounted in appropriately provided guideways 26 for controlled vertical reciprocation and is operatively associated with the press bed 22 to effect work on work pieces. A die set, which may be of the self-contained interchangeable type, is mounted in the press with its die block portion 28 being rigidly secured to the bed 22 and its punch block portion 30 being secured to the ram 24.

As is well known in the art, the die block 28 is stationary and the punch block 30 vertically reciprocates with the ram 24 relative to the die block. Dies are mounted in fixed positions on the die block to be operatively associated with punch tools that are mounted in fixed position on the punch block 30 and which, therefore, vertically reciprocate with the ram and the punch block relative to tee die block and dies mounted therein. The ram is vertically reciprocated by known ram cam and roller mechanism that is mounted within housing portions under the crown 14. The ram cam mechanism is mounted on a ram cam shaft 32 extending between the vertical walls 16 and 18. The drive for the ram cam shaft comprises a bull gear which is mounted within housing 34, a fly wheel 36 and a motor 38 which is the main source of power for operating the multi-station press. The power drive includes an air clutch-brake of known construction.

The multi-station press 10 includes a vertically extending side shaft 40 for driving various sub-assemblies, side shaft 40 being driven at its upper end through bevel gears, in housing 41, driven by the ram cam shaft 32. At the lower end of the side shaft 40, additional bevel gears in housing 42 are provided to drive a lower shaft 44 also extending between the side walls 16 and 18. The shaft 44 mounts the cams of a knock-out mechanism 46, for removing work pieces from the die block 28, as is well known.

The dies in the die block 28 are designed to cooperate with the punches on punch block 30 to perform sequential forming operations required to make a finished part from a metal blank. The transfer mechanism according to the invention herein, generally indicated by the numeral 50, accomplishes the task of moving work pieces from one die work station to the next between work strokes of the metal forming press. The transfer mechanism includes a plurality of sets of opposed fingers, and one set of fingers picks up a work piece at a particular die station as it is stripped from the punch block, transfers the work piece to the next work station where the punch drives the work piece into the die at the start of the work stroke of the press. As the work pieces are being formed in the dies, the transfer mechanism returns the fingers to their previous stations, to pick up the next work pieces for forward transfer.

Figure 5:
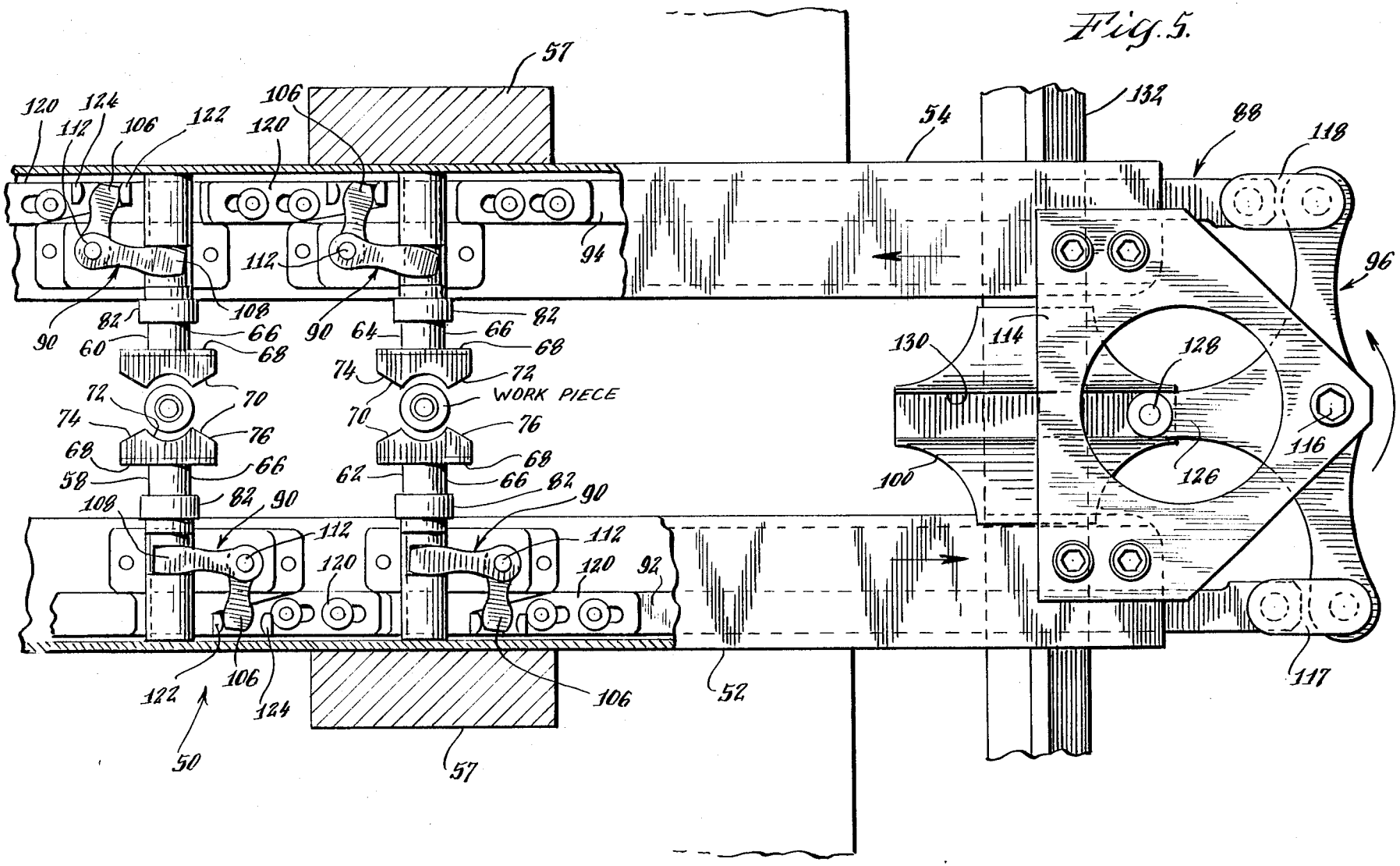
FIG. 5 is a partial sectional view of the multi-station press of FIG. 1, similar to the view of FIG. 2, but showing the fingers in the open position.

With reference to FIGS. 1, 2 and 5, the transfer mechanism 50 comprises a first, front transfer rail 52 and a second, spaced-apart rear transfer rail 54 which, as viewed in FIG. 1, are connected together at their left-hand ends and driven in reciprocating motion timed with the stroke of the press by a cam 56, as is well-known in transfer mechanisms. The transfer rails are mounted in slide supports 57 on the press bed 22.

With reference to FIGS. 2 and 5, extending inwardly from the front and rear transfer rails are cooperating sets of fingers for each of the die work stations. Thus, fingers 58 and 60, respectively extending inwardly from the transfer rails 52 and 54, cooperate to grip a work piece, as do fingers 62 and 64 at the adjacent die work station. The structure of the fingers is best seen in FIG. 3, where finger 58 comprises a shaft 66 having a plate 68 at the inner end thereof. Secured to the plate 68 is a finger pad 70 which may be fabricated of nylon, plastic, or the like. The finger pad 70 includes a concave portion 72 (best seen in FIGS. 2 and 5), shaped to receive the work piece and further includes leading and trailing cam surfaces 74, 76, (see FIG. 2) and upper and lower cam surfaces 78 and 80, which permit the finger pad to cam over a work piece or punch, if necessary. The shaft 66 is carried in bushings 82, 84 mounted in the transfer rail 52. The shaft 66 is hollow along a substantial portion of its length, and receives a spring 86 biasing the finger inwardly. The structure of the other fingers is similar.

A finger operating mechanism 88 for positively opening the fingers avoids the need to cam the fingers onto the work pieces and around punches. The finger operating mechanism 88 generally comprises a plurality finger pull-back levers 90 (one for each of the fingers), actuating rods 92 and 94 in the front and rear transfer rails 52 and 54, respectively, for operating the finger pull-back levers, and an actuating lever 96 connected for driving the actuating rods, all of these elements being mounted for reciprocal motion with the transfer rails 52 and 54. The finger operating mechanism 88 further comprises a roll slot member 100 lateral movement of which rotates the actuating lever 96 while accommodating reciprocal longitudinal motion of the transfer rails and the elements mounted thereto. The roll slot member is operated by a cam lever 102 which is in turn operated by a cam assembly 104. One particular aspect of the invention herein is the dual cam follower of the cam lever 102 and the adjustable structure of cam assembly 104 which results in positive operation of the cam lever 102 and the entire mechanical linkage.

Referring now to FIGS. 2 and 5 and also to FIG. 4, a finger pull-back lever 90 is respectively associated with each of the fingers and functions to translate motion of the actuating rods 92, 94 to the shafts of the fingers. When viewed in plan, the finger pull-back lever 90 is L-shaped, having a first arm 106 extending over the actuating rod 92 to be engaged there, and a second, bifurcated leg 108 which embraces the shaft 66 in a slotted portion 110 thereof. The finger pull-back lever 90 is pivotally mounted to the transfer rail by means of a pivot pin 112. The bifurcated leg 108 embracing the shaft 66 within slot 110 is also illustrated in FIG. 3. Thus, rotation of the finger pull-back levers 90 associated with fingers 58 and 62 in the counterclockwise direction about their pivot pins, as viewed in FIGS. 2, serves to open or retract the fingers 58 and 62 to the position shown in FIG. 5. The fingers 60 and 64 extending inwardly from transfer rail 54 are similarly operated by their associated finger pull-back levers, except that the pivot pins are positioned on the opposite side of the fingers.

The finger pull-back levers are operated by the actuating rods 92, 94 and the actuating lever 96. More particularly, a bracket 114 is provided extending between and joining the ends of the transfer rails 52 and 54, opposite the cam 56 for the transfer rails and at the right side of the multi-station metal forming press 10 as it is shown in FIG. 1. The actuating lever 96 is pivotally mounted to the bracket 114 by pivot pin 116, whereby the actuating lever is carried with the transfer rails as they reciprocate during operation of the press. The actuating lever 96 is generally T-shaped, with the top arm of the T extending between the actuating rods 92 and 94 respectively carried in the transfer rails 52 and 54. The actuating rod 92 is connected to one side of the actuating lever 96 by a link 117 and the other end of the actuating lever is connected to actuating rod 94 by link 118. Therefore, rotation of the actuating lever 96 about the pivot 116 in the clockwise direction drives actuating rod 92 to the left and actuating rod 94 to the right, as viewed and indicated in FIG. 2. Conversly, rotation of the actuating lever 96 in the counterclockwise direction drives actuating rod 92 to the right and actuating rod 94 to the left, as viewed and indicated in FIG. 5.

The actuating rods are carried in channels in the transfer rails, as best seen in FIG. 3 with respect to transfer rail 52 and actuating rod 92. The actuating rods are deployed adjacent each of the finger locations. Referring again to FIG. 4, a finger pull-back lug 120 is secured to the actuating rod 52. The finger pull-back lug is characterized by an upstanding finger pull-back tooth 122, which is disposed for abutting engagement with arm 106 of the finger pull-back lever 90. In the embodiment shown, the finger pull-back lug also comprises a second tooth 124 which is preferably not tightly butted against the lever 106; however, this second tooth is optional. Of course, an additional finger pull-back lug is provided for each of the other finger pull-back levers at the other finger stations. It should also be understood and seen in the drawing that the transfer rails have cavities and openings formed therein to accommodate the fingers, finger pull-back levers, actuating rods and finger pull-back lugs, as required.

It can now be seen that rotation of the actuating lever 96 in the counterclockwise direction, as indicated in FIG. 5, pulls the actuating rod 92 to the right, whereby the finger pull-back teeth 122 engage with the arms 106 of the finger pull-back levers 90, thereby rotating the levers and opening the fingers on transfer rail 52. Simultaneously, the actuating rod 94 is pushed to the left, also engaging the teeth 122 of the pull-back lugs on actuating rod 94 with the arms 106 of finger pull-back levers 90 associated with the fingers on transfer rail 54, thereby opening those fingers as well.

When the actuating lever 96 is rotated counterclockwise, as is illustrated in FIG. 2, the actuating rods move in the opposite direction and permit the fingers to close, either under influence of the springs 86 or assisted by engagement of the optional teeth 124 with the arm 106 of each finger pull-back lever 90. In the embodiment shown, the tooth 124 is positioned to bump the fingers inwardly if the spring fails or is slow to do so, i.e. there is a little slack between the tooth 124 and the lever 106.

The actuating lever 96 is rotated by the roll slot member 100. With continued reference to FIGS. 2 and 5, the roll slot member 100 defines a longitudinal slot 130 and the actuating lever 96 comprises an additional arm 126 extending from the first arm 106 and pivot pin 116, the free end of arm 126 having a depending follower roller 128 mounted thereto and extending downwardly into the slot 130. Therefore, lateral displacement of the roll slot member 100 serves to rotate the actuating lever 96.

The roll slot member 100 is mounted to the frame of the multi-station press 10 and does not reciprocate with the transfer rails 52, 54 and the actuating lever 96. However, the slot 130 is sufficiently long that the roller 128 remains received within the slot 130 during such reciprocating movement. This is again best seen in FIGS. 2 and 5, with the transfer rails and actuating lever 96 positioned toward the left in FIG. 2, wherein the roller 128 is at the left end of slot 130, and the transfer rails are positioned to the right in FIG. 5, with the roller 128 at the left end of the slot 130.

Figures 6, 8:
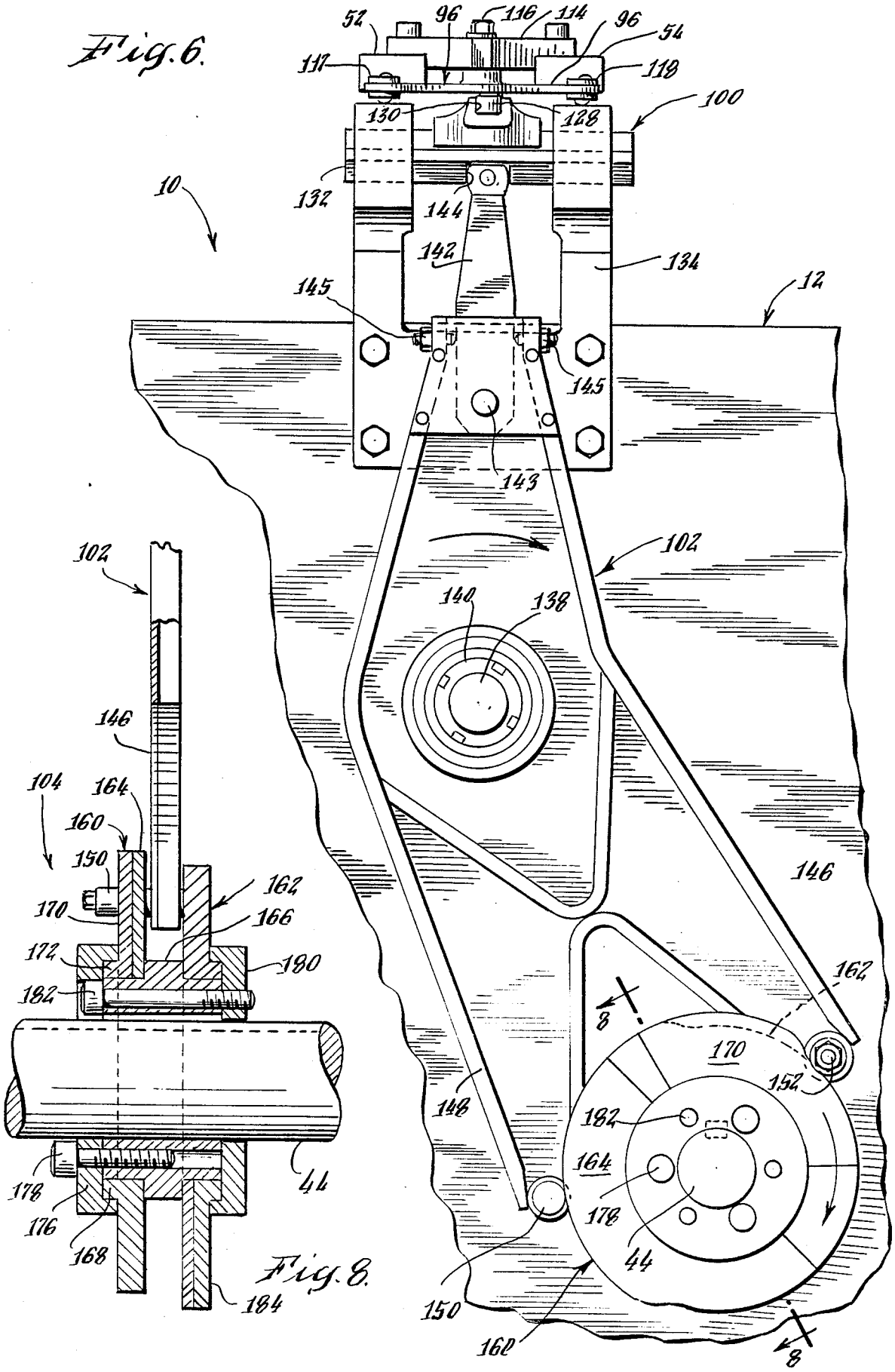
FIG. 6 is a partial end elevation view of the multi-station press of FIG. 1, showing a cam drive for the finger operating mechanism.
FIG. 8 is a sectional view, taken along the lines 8—8 of FIG. 6, showing the adjustment feature of the cam drive for the finger operating mechanism according to the invention herein.
Figure 7:
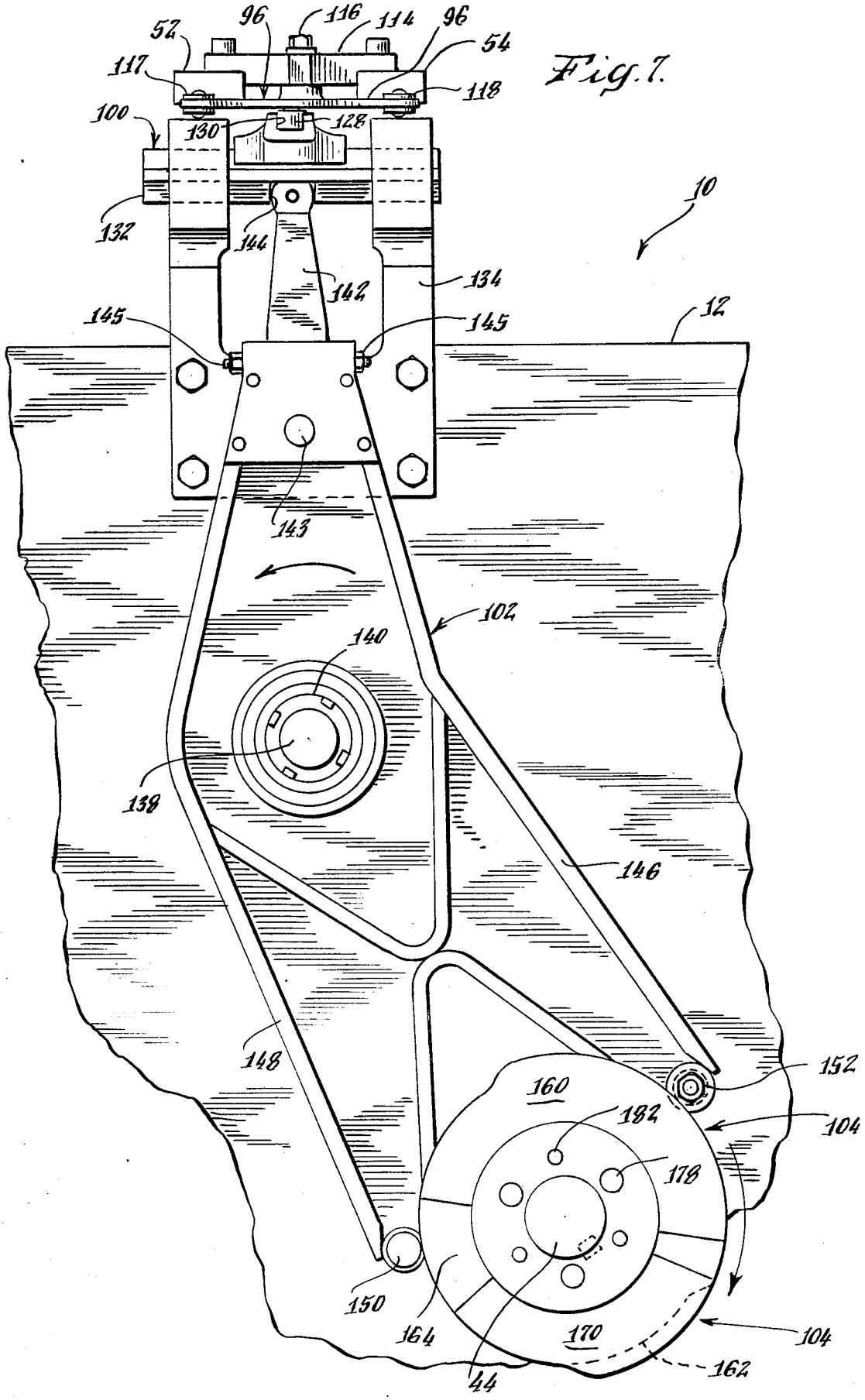
FIG. 7 is a partial end elevation view of the multi-station press, similar to FIG. 6, with the cam drive operating the fingers to the open position.

With reference to FIGS. 6 and 7, the roll slot member 100 includes a slide bar 132, which is mounted in a yoke 134 upstanding from the frame 12 of the multi-station press 10. More particularly, the roll slot member 100 is mounted for side to side sliding movement in the yoke 134, as viewed in FIGS. 6 and 7. The yoke 134 is provided with suitable precision ground bearing surfaces receiving the slide bar 132, for this purpose.

The roll slot member 100 is driven from side to side to operate the fingers by cam lever 102 and cam assembly 104. The cam lever 102 is pivotally mounted to shaft 138 extending from the press frame 12 by means of a bearing assembly 140. The upper end of the cam lever 102 is provided with an adjustable end arm 142 which is received in a slot opening 144 in the slide bar 132 of roll slot member 100. The lower end of the cam lever 102 is bifrucated into legs 146 and 148, which are respectively provided with roller type ca followers 150 and 152 at their distall ends.

Referring also to FIG. 8, the cam assembly 104 comprises two individual cams 160 and 162 which are mounted spaced apart on shaft 44. The bifurcated end of cam lever 102 is positioned generally between the two cams 160 and 162, whereby the cam follower 150 extends in one direction to engage the front cam 160 and the cam follower 152 extends in the opposite direction to engage the rear cam follower 162.

The cams 160 and 162 are made of composite adjustable parts and are mounted in a hub assembly 166, which permits adjustment of the position of the entire cams and of their composite parts. The cam 160 comprises a major profile segment 164 which takes the form of a plate having a cam profile about its peripheral surface and having a central opening whereby it is received on a hub 166. The major profile segment 164 is full width about 180° thereof, the full width portion being shown on the lower portion of FIG. 8 and it includes a lip 168. The remaining portion of the major profile segment 164 is provided as approximately half width, which may also be thought of as a 180° notch for receiving an adjustment segment 170. The adjustment segment 170 occupies only 120° of the 180° notch, whereby it may be adjustably positioned in the notch. The adjustment segment 170 also has a mounting flange 172 corresponding to the flange 168 of the major profile segment. The cam assembly 104 further comprises a front clamp 176 which is secured to the hub 166 by bolts 178, and a rear clamp 180, which is secured to the opposite side of the hub 166 by bolts 182. It will be noted that the bolts 182 are accommodated in an opening in the front clamp 176 and are threaded into the rear clamp 180, so that the rear clamp 180 may be loosened from the front of the cam assembly 104. Accordingly, the position of the front cam 160 as well as the position of its adjustment segment 170, may be adjusted by loosening the bolts 178, setting the elements to the desired position and retightening the bolts 178, without disturbing the position of the rear cam 162. The rear cam 162 is similarly constructed with an adjustment segment 184, and the entire cam 162 and its adjustment segment 184 may be adjusted by loosening bolts 182 without disturbing the adjustment of the front cam.

The cams 160 and 162 are ground to the desired profile with the adjustment segments at a maximum adjustment position, whereby the adjustment segments may then be moved to alter the timing of the cam. It will be understood that the cam follower always rides on the highest portion of the cam, i.e. on the adjustment segment when the adjustment segment is moved from the extreme adjustment position, and on both the major profile segment and the adjustment segment where the two coincide.

As noted above, the upper end of the cam lever 102 is provided with an arm 142, which is pivotally mounted at 143. Adjustment screws 145 therefore adjust the fine position of the arm 142 for further fine adjustment of the relationship between the cam drive and the opening of the fingers on the transfer rails.

The cam assembly 104 is with its highly flexible adjustment features is preferred in conjunction with the cam lever having dual cam followers as it facilitates setting the cams so that there is solid contact with both cam followers during operation, achieving positive drive of the elements of the finger operating mechanism.

The finger operating mechanism retracts the fingers by positive drive, with the timing and duration of the retraction being determined by cam assembly 104, independent of the timing of the ram strokes or transfer mechanism reciprocation. The finger operating mechanism is further positively driven to release the fingers for spring biased closing action or to drive the fingers closed, if desired. The positive drive is capable of high speed operation with reliability and durability.

The preferred embodiment described above admirably achieves the objects of the invention; however, it will be appreciated that modifications may be made by those skilled in the art without departing from the spirit and scope of the invention, which is embodied in the following claims:

I claim:

1. A finger operating mechanism for a multiple station metal forming press of the type having a press frame, a press bed and ram tooled for performing sequential work operations on work pieces at a plurality of longitudinally spaced work stations along a longitudinal axis, power driven shaft means for reciprocating the ram and for driving a transfer mechanism and other press elements, the transfer mechanism including spaced-apart transfer rails deployed for reciprocal longitudinal sliding movement flanking the work station, fingers extending inwardly from the rails toward the work stations, the fingers being deployed in opposed pairs spaced apart by the distance between the work stations, the fingers being spring biased to an operative position holding work pieces retractable to release the work pieces, and cam means driving the transfer rails in reciprocal longitudinal motion so that the fingers are positioned alternately at adjacent work stations, the finger operating mechanism being adapted for retracting at least one pair of opposed fingers independently of the motion of the transfer rails and comprising:

(A) an actuating rod for each transfer rail, each actuating rod being mounted for sliding longitudinal movement along its respective transfer rail adjacent the finger station thereon;

(B) a finger pull-back lever for each finger operated by the finger operating mechanism, each finger pull-back lever being pivotally mounted to its respective transfer rail and having one arm engaged with the finger;

(C) means engaging the actuating rod with the finger pull-back lever such that sliding movement of the actuating rod retracts the finger;

(D) an actuating lever pivotally mounted to the transfer rails and connected to the actuating rods such that pivoting the actuating lever effects mechanical retraction of the fingers, the actuating lever including a follower;

(E) a roll slot member mounted for lateral sliding movement with respect to said longitudinal axis on the press frame, the roll slot member defining a longitudinal roll slot receiving the follower of the actuating lever and accommodating the longitudinal motion of the follower as the transfer rails reciprocate; and (F) cam drive means for driving the roll slot member in lateral movement to retract the fingers, the cam drive means including a profiled cam assembly driven by the power driven shaft means of the press profile and the cam assembly determining the time and duration of finger retraction.

2. A finger operating mechanism as defined in claim 1 wherein the finger pull-back lever has two arms deployed in an L-shaped configuration and is pivotally mounted to the transfer rail at the intersection of the two arms, one of the arms being engaged with the finger and the other of the arms being deployed adjacent the actuating rod.

3. A finger operating mechanism as defined in claim 2 wherein the arm of the finger pull-back lever engaged with the finger is bifurcated and embraces the finger, and the finger is slotted for receiving the bifurcated arm.

4. A finger operating mechanism as defined in claim 3 wherein the means engaging the finger pull-back lever is a tooth upstanding from the actuating rod adjacent to and in abutting relationship with the arm of the finger pull-back lever.

5. A finger operating mechanism as defined in claim 4 wherein the tooth is formed on a lug secured to the actuating rod.

6. A finger operating mechanism as defined in claim 4 and further comprising a second tooth upstanding from the actuating rod adjacent to and in loosely abutting relationship with the finger lever on the opposite side thereof from the first tooth, wherein said second tooth is operative to rotate the finger lever to drive the finger positively into operative position for engaging a work piece.

7. A finger operating mechanism as defined in claim 1 wherein the means engaging the finger pull-back lever is a tooth upstanding from the actuating rod adjacent to and in abutting relationship with the finger lever.

8. A finger operating mechanism as defined in claim 7 and further comprising a second tooth upstanding from the actuating rod adjacent to and in loosely abutting relationship with the finger lever on the opposite side thereof from the first tooth, wherein said second tooth is operative to rotate the finger lever to drive the finger positively into operative position for engaging a work piece.

9. A finger operating mechanism as defined in claim 1 wherein the means engaging the actuating rod with the finger pull-back lever such that sliding movement of the actuating rod retracts the finger also engages the actuating rod with the finger pull-back lever such that sliding movement of the actuating rod in the opposite direction positively drives the finger to its operative position engaging a work piece.

10. A finger operating mechanism as defined in claim 9 wherein the means engaging the actuating rod with the finger pull-back lever such that sliding movement of the actuating rod in the opposite direction positively drives the finger to its operative position engaging a work piece provides loose engagement with the actuating rod, whereby the spring biased of the finger has the initial opportunity to return the finger to its operative position and the positive drive does so if the spring is slow or fails to return the finger to its operative position.

11. A finger operating mechanism as defined in claim 1 wherein the fingers are provided with non-metallic fingertip pads shaped to embrace the work pieces.

12. A finger pull-back mechanism as defined in claim 1 wherein the cam drive means comprises a cam lever pivotally mounted to the press frame, one end of the cam lever being driven by the profiled cam assembly and the other end of the cam lever being engaged with the roll slot member for transmitting the cam driven lever motion thereto.

13. A finger operating mechanism as defined in claim 12 wherein the driven end of the cam lever has two spaced apart cam followers mounted thereon, the two cam followers engaging the cam assembly to provide positively driven cyclical movement of the cam lever.

14. A finger operating mechanism as defined in claim 13 wherein the cam assembly comprises two cams, the cams being coaxially mounted to the same drive shaft, wherein one of the cams engages with one of the cam followers on the cam lever and the other cam engages with the other cam follower on the cam lever and the two cams are adjustably positioned on the drive shaft relative to each other.

15. A finger operating mechanism as defined in claim 14 wherein at least one of the cams of the cam assembly includes a major profile segment and an adjustment segment defining a transition part of the cam profile, the adjustment segment being adjustably secured to the main profile segment to adjust the cam timing.

16. A finger operating mechanism as defined in claim 15 wherein both cams of the cam assembly include main profile segments adjustment segments defining a transition portion of the cam profiles, the adjustment segments being adjustably secured to their respective main profile segments to adjust cam timing.

17. A finger operating mechanism as defined in claim 15 wherein the major profile segment of the cam has full thickness about an approximately 180° arc and a one half thickness about the remaining 180° of its arc, and the adjustment segment is one half the thickness of the full width portion of the full profile segment and is received adjacent the half width portion of the major profile segment, the adjustment segment comprising 120° or less arc to provide for up to 60° of adjustment.

18. A finger operating mechanism as defined in claim 14 wherein the cam assembly further comprises a mounting hub, a front clamp for clamping one of the cams to the mounting hub, a rear clamp for clamping the other cam to the mounting hub and bolts for independently drawing the front and rear clamps and mounting hub together, wherein the bolts have heads which are deployed on one side of the cam assembly and may be loosened to independently to adjust the position of the two cams.

19. A finger operating mechanism as defined in claim 14 wherein the end of the cam lever engaged with the roll slot member includes an adjustment arm and means for securing the adjustment arm in a fixed adjusted position, the adjustment arm permitting fine adjustment of the relative position of the cam lever and roll slot member.

20. A finger operating mechanism as defined in claim 12 wherein the end of the cam lever engaged with the roll slot member includes an adjustment arm and means for securing the adjustment arm in a fixed adjusted position, the adjustment arm permitting fine adjustment of the relative position of the cam lever and roll slot member.

21. A finger operating mechanism for a multiple station metal forming press of the type having a press frame, a press bed and ram tooled for performing sequential work operations on work pieces at a plurality of longitudinally spaced work stations, power driven shaft means for reciprocating the ram and for driving a transfer mechanism and other press elements, the transfer mechanism including spaced-apart transfer rails deployed for reciprocal longitudinal sliding movement flanking the work station, fingers extending inwardly from the rails toward the work stations, the fingers being deployed in opposed pairs spaced apart by the distance between the work stations, the fingers being spring biased to an operative position holding work pieces retractable to release the work pieces, and cam means driving the transfer rails in reciprocal longitudinal motion so that the fingers are positioned alternately at adjacent work stations, the finger operating mechanism being adapted for retracting at least one pair of opposed fingers independently of the motion of the transfer rails and comprising:

(A) an actuating rod for each transfer rail, each actuating rod being mounted for sliding longitudinal movement along its respective transfer rail adjacent the finger station thereon;

(B) a finger pull-back lever for each finger operated by the finger operating mechanism, each finger pull-back lever being pivotally mounted to its respective transfer rail and having one arm engaged with the finger;

(C) means engaging the actuating rod with the finger pull-back lever such that sliding movement of the actuating rod retracts the finger;

(D) an actuating lever pivotally mounted to the transfer rails and connected to the actuating rods such that pivoting the actuating lever effects mechanical retraction of the fingers, the actuating lever including a follower; and (E) means mounted on the press frame for engaging the follower and pivoting the actuating lever to effect mechanical retraction of the fingers.

22. A finger operating mechanism as defined in claim 21 wherein the finger pull-back lever has two arms deployed in an L-shaped configuration and is pivotally mounted to the transfer rail at the intersection of the two arms, one of the arms being engaged with the finger and the other of the arms being deployed adjacent the actuating rod.

23. A finger operating mechanism as defined in claim 22 wherein the arm of the finger pull-back lever engaged with the finger is bifurcated and embraces the finger, and the finger is slotted for receiving the bifurcated arm.

24. A finger operating mechanism as defined in claim 22 wherein the means engaging the finger pull-back lever is a tooth upstanding from the actuating rod adjacent to and in abutting relationship with the arm of the finger pull-back lever.

25. A finger operating mechanism as defined in claim 21 wherein the means engaging the finger pull-back lever is a tooth upstanding from the actuating rod adjacent to and in abutting relationship with the finger lever.

26. A finger operating mechanism as defined in claim 25 and further comprising a second tooth upstanding from the actuating rod adjacent to and in loosely abutting relationship with the finger lever on the opposite side thereof from the first tooth, wherein said second tooth is operative to rotate the finger lever to drive the finger positively into operative position for engaging a work piece.

27. A finger operating mechanism as defined in claim 25 wherein the is formed on a lug secured to the actuating rod.

28. A finger operating mechanism as defined in claim 21 wherein the means engaging the actuating rod with the finger pull-back lever such that sliding movement of the actuating rod retracts the finger also engages the actuating rod with the finger pull-back lever such that sliding movement of the actuating rod in the opposite direction positively drives the finger to its operative position engaging a work piece.

29. A finger operating mechanism as defined in claim 21 wherein the fingers are provided with non-metallic fingertip pads shaped to embrace the work pieces.

30. A finger operating mechanism for a multiple station metal forming press of the type having a press frame, a press bed and ram tooled for performing sequential work operations on work pieces at a plurality of longitudinally spaced work stations along a longitudinal axis, power driven shaft means for reciprocating the ram and for driving a transfer mechanism and other press elements, the transfer mechanism including spaced-apart transfer rails deployed for reciprocal longitudinal sliding movement flanking the work station, fingers extending inwardly from the rails toward the work stations, the fingers being deployed in opposed pairs spaced apart by the distance between the work stations, the fingers being spring biased to an operative position holding work pieces retractable to release the work pieces, and cam means driving the transfer rails in reciprocal longitudinal motion so that the fingers are positioned alternately at adjacent work stations, the finger operating mechanism being adapted for retracting at least one pair of opposed fingers independently of the motion of the transfer rails and comprising:

(A) a mechanical linkage mounted to and carried with the transfer rails, and adapted for retracting the fingers of the transfer mechanism, the mechanical linkage including a follower which, when moved laterally with respect to the longitudinal motion of the transfer rails, operates the mechanical linkage to retract the fingers;

(B) a roll slot member mounted for lateral sliding movement with respect to said longitudinal axis on the press frame, the roll slot member defining a longitudinal roll slot receiving the follower of the mechanical linkage and accommodating the longitudinal motion of the follower as the transfer rails reciprocate; and (C) cam drive means for, driving the roll slot member in lateral movement moving in a plane substantially parallel with the plane defined by the two transfer rails to retract the fingers, the cam drive means including a profiled cam assembly driven by the power driven shaft means of the press profile and the cam assembly determining the time and duration of finger retraction.

31. A finger pull-back mechanism as defined in claim 30 wherein the cam drive means comprises a cam lever pivotally mounted to the press frame, one end of the cam lever being driven by the profiled cam assembly and the other end of the cam lever being engaged with the roll slot member for transmitting the cam driven lever motion thereto.

32. A finger operating mechanism as defined in claim 31 wherein the driven end of the cam lever has two spaced apart cam followers mounted thereon, the two cam followers engaging the cam assembly to provide positively driven cyclical movement of the cam lever.

33. A finger operating mechanism as defined in claim 32 wherein the cam assembly comprises two cams, the cams being coaxially mounted to the same drive shaft, wherein one of the cams engages with one of the cam followers on the cam lever and the other cam engages with the other cam follower on the cam lever and the two cams are adjustably positioned on the drive shaft relative to each other.

34. A finger operating mechanism as defined in claim 33 wherein at least one of the cams of the cam assembly includes a major profile segment and an adjustment segment defining a transition part of the cam profile, the adjustment segment being adjustably secured to the main profile segment to adjust the cam timing.

35. A finger operating mechanism as defined in claim 34 wherein both cams of the cam assembly include main profile segments adjustment segments defining a transition portion of the cam profiles, the adjustment segments being adjustably secured to their respective main profile segments to adjust cam timing.

36. A finger operating mechanism as defined in claim 34 wherein the major profile segment of the cam has full thickness about an approximately 180° arc and a one half thickness about the remaining 180° of its arc, and the adjustment segment is one half the thickness of the full width portion of the full profile segment and is received adjacent the half width portion of the major profile segment, the adjustment segment comprising 120° or less arc to provide for up to 60° of adjustment.

37. A finger operating mechanism as defined in claim 33 wherein the cam assembly further comprises a mounting hub, a front clamp for clamping one of the cams to the mounting hub, a rear clamp for clamping the other cam to the mounting hub and bolts for independently drawing the front and rear clamps and mounting hub together, wherein the bolts have heads which are deployed on one side of the cam assembly and may be loosened to independently to adjust the position of the two cams.

38. A finger operating mechanism as defined in claim 33 wherein the end of the cam lever engaged with the roll slot member includes an adjustment arm and means for securing the adjustment arm in a fixed adjusted position, the adjustment arm permitting fine adjustment of the relative position of the cam lever and roll slot member.

39. A finger operating mechanism as defined in claim 31 wherein the end of the cam lever engaged with the roll slot member includes an adjustment arm and means for securing the adjustment arm in a fixed adjusted position, the adjustment arm permitting fine adjustment of the relative position of the cam lever and roll slot member.

* * * * *

UNITED STATES PATENT AND TRADEMARK OFFICE

CERTIFICATE OF CORRECTION

PATENT NO. : 4,896,523

DATED : Jan. 30, 1990

INVENTOR(S) : David W. Knight

It is certified that error appears in the above-identified patent and that said Letters Patent is hereby corrected as shown below:

| | |
|---|---|
| Col. 4, line 53: | Delete "n" and substitute therefor --in--. |
| Col. 5, line 12: | Delete "tee" and substitute therefor --the--. |
| Col. 6, line 14: | After "plurality" insert --of--. |
| Col. 8, line 16: | Delete "ca" and substitute therefor --cam--. |
| Col. 9, line 9: | After the number "104" delete "is". |
| Col. 11, line 2: | Delete "biased" and substitute therefor --bias--. |

Signed and Sealed this

Fifth Day of February, 1991

*Attest:*

*Attesting Officer*

HARRY F. MANBECK, JR.

*Commissioner of Patents and Trademarks*